US005611706A

United States Patent [19]

Makita et al.

[11] Patent Number: 5,611,706

[45] Date of Patent: Mar. 18, 1997

[54] RUBBER WATERPROOF PLUG

[75] Inventors: Toshihiko Makita; Akira Maeda, both of Shizuoka-ken, Japan

[73] Assignee: Yazaki Corporation, Tokyo, Japan

[21] Appl. No.: 396,603

[22] Filed: Mar. 1, 1995

[30] Foreign Application Priority Data

Mar. 4, 1994 [JP] Japan ..... 6-034487
Sep. 7, 1994 [JP] Japan ..... 6-213654

[51] Int. Cl.[6] ..... H01R 13/52

[52] U.S. Cl. ..... 439/275; 439/587

[58] Field of Search ..... 439/587, 588, 439/589, 271–275, 595, 842, 606, 736; 29/883, 888.3; 264/163, 328.2

[56] References Cited

U.S. PATENT DOCUMENTS

| | | | |
|---|---|---|---|
| 92,567 | 7/1869 | Belaieff | 470/85 |
| 868,168 | 10/1909 | Doolittle | 470/66 |
| 3,787,796 | 1/1974 | Barr | 339/60 R |
| 4,193,655 | 3/1980 | Herrmann, Jr. | 439/589 |
| 4,255,479 | 3/1981 | Murray | 264/153 |
| 4,797,116 | 1/1989 | Isohata et al. | 439/274 |
| 4,802,867 | 2/1989 | Palmer | 439/587 |
| 4,969,841 | 11/1990 | Sueyoshi | 439/595 |
| 5,147,222 | 9/1992 | Hotea et al. | 439/589 |
| 5,266,045 | 11/1993 | Yamamoto et al. | 439/587 |
| 5,433,621 | 7/1995 | Sai | 439/275 |

FOREIGN PATENT DOCUMENTS 62-163879 10/1987 Japan .

*Primary Examiner*—Neil Abrams
*Assistant Examiner*—Brian J. Biggi
*Attorney, Agent, or Firm* Wigman, Cohen, Leitner & Myers, P.C.

[57] ABSTRACT

A rubber waterproof plug (25) is fitted to an outer circumference of a wire (27) extending from a terminal (29) and then inserted into a terminal accommodation chamber (31) formed in a connector housing (20) together with the terminal from a rear end of the connector housing, in order to seal a gap between the wire (27) and an inner wall (31*a*) of the terminal accommodation chamber (31). The waterproof plug is formed with: a clamp connection portion (33) formed at a front end portion of the waterproof plug and clamped with a front end of the wire by the terminal; and an airtight portion (47) of annular gill-shaped projections (49) formed at a rear end portion of the waterproof plug, for airtightly closing an opening (51) of the terminal accommodation chamber. In particular, an axial length of the annular gill-shaped projections (49) is determined in such a way that a rear end portion thereof is flush with or projects outside from an end surface (51*a*) of the opening (51) of the terminal accommodation chamber, irrespective of clamped position of the clamp connection portion (33) relative to the terminal. Therefore, even if the waterproof plug is dislocated slightly in the connector housing, it is possible to prevent water from staying at the opening surface of the connector housing, thus improving the reliablity of the waterproof plug.

5 Claims, 6 Drawing Sheets

RUBBER WATERPROOF PLUG

BACKGROUND OF THE INVENTION

1. Field of the Invention

The present invention relates to a rubber waterproof plug and a manufacturing method of the same rubber waterproof plug, and more specifically to a rubber waterproof plug for a connector, which is clamped to a wire by a terminal and then inserted into a terminal accommodation chamber of tile connector to waterproof a gap between the wire and an inner wall of the terminal accommodation chamber.

2. Description of Related Art

An example of the rubber waterproof plug for a connector is disclosed in Japanese Published Unexamined (Kokai) Utility Model Application No. 62-163879, which is formed of a soft synthetic rubber integrally. The rubber waterproof plug is composed of a clamp connection portion clamped to a wire end by a clamp portion of a terminal and a seal portion brought into tight contact with an inner wall of a terminal accommodation chamber of the connector housing. In assembly, a wire is passed through a central hole of the waterproof plug in an axial direction thereof under airtight condition, and further the waterproof plug is fixed to the wire by clamping the clamp connection portion of the waterproof plug to the outer circumferential surface of the wire by use of the clamp portion of the terminal. The seal portion is formed with a plurality of annular lip portions projecting radially outward from the outer circumference of the seal portion. Therefore, when the waterproof plug is inserted into the terminal accommodation chamber these annular lip portions are brought into tight contact with the inner wall of the terminal accommodation chamber, so that it is possible to seal a gap between the outer circumference of the wire and the inner wall of the terminal accommodation chamber of the connector housing.

When the rubber waterproof plug is inserted into the terminal accommodation chamber, the rubber waterproof plug connected to the terminal is inserted from a rear opening of the terminal accommodation chamber until the terminal is engaged with a flexible engage arm formed in the inner wall of the terminal accommodation chamber. Under these conditions, since the terminal can be fixed in the terminal accommodation chamber in position, the waterproof plug can be also accommodated in the terminal accommodation chamber. In addition, under these conditions, in the rubber waterproof plug inserted into the terminal accommodation chamber together with the terminal from the rear opening of the connector housing, since the annular lip portions are brought into tight contact with the inner wall of the terminal accommodation chamber, and further since the wire is also brought into tight contact with the inner wall of the waterproof plug, it is possible to securely waterproof an inner gap between the outer circumference of the wire and the inner circumference of the waterproof plug and an outer gap between the outer circumference of the waterproof plug and the inner wall of the terminal accommodation chamber.

In the conventional rubber waterproof plug, however, when the rubber waterproof plug is inserted deep into the terminal accommodation chamber of the connector housing excessively together with the terminal, a rear end of the waterproof plug is inserted deep into the terminal accommodation chamber from the rear opening thereof, so that a recessed portion is inevitably produced at the rear opening of the terminal accommodation chamber.

Further, when the terminal clamp portion is not clamped to the clamp connection portion of the waterproof plug accurately at a predetermined position, since the position of the waterproof plug can vary along the axial direction of the terminal accommodation chamber, the rear end portion of the waterproof plug is sometimes inserted excessively deep into the terminal accommodation chamber, so that a recessed portion is produced in the same way at the rear opening portion of the terminal accommodation chamber. Once this recessed portion is produced, since water tends to stay at this recessed portion, there exists such a problem in that the water staying at the recess portion enters a gap between the outer circumference of the waterproof plug and the inner wall of the terminal accommodation chamber, in particular when the connector housing is vibrated or heated.

To overcome this problem, it is possible to eliminate the recessed portion by inserting the waterproof plug to such a position that the rear end of the waterproof plug is flush with the rear end surface of the opening of the connector housing. In this case, when the large diameter annular lip portion of the seal portion is located at the rear opening end of the connector housing, the recessed portion may not be produced and thereby no water stays thereat. However, when the small diameter annular lip portion of the seal portion is located at the rear opening end of the connector housing, since a recessed portion is inevitably produced, water stays at this recessed portion.

To overcome this problem, it is possible to consider that the waterproof plug must be inserted into the terminal accommodation chamber in such a way that the large diameter annular lip portion is always located at the rear opening end surface of the connector housing. However, since the waterproof plug is formed of a soft rubber and therefore easily slipped or dislocated when or after attached, it is very difficult to locate the large diameter annular lip portion of the waterproof plug accurately always at the rear opening end surface of the connector housing.

SUMMARY OF THE INVENTION

With these problems in mind, therefore, it is the object of the present invention to provide a rubber waterproof plug which can waterproof a gap between a wire and a terminal accommodation chamber of a connector housing securely, even if the rubber waterproof plug is dislocated or slipped relative to the terminal position in the terminal accommodation chamber of the connector housing.

Further, the other object of the present invention is to provide a method of manufacturing the rubber waterproof plug as described above.

To achieve the above-mentioned object, the present invention provides a rubber waterproof plug (25) fitted to an outer circumference of a wire (27) extending from a terminal (29) and inserted into a terminal accommodation chamber (31) formed in a connector housing (20) together with the terminal from a rear end of the connector housing, to seal a gap between the wire (27) and an inner wall (31*a*) of the terminal accommodation chamber (31), which is formed with: a clamp connection portion (33) formed at a front end portion of the waterproof plug and clamped with a front end of the wire by the terminal; and an airtight portion (47) formed at a rear end portion of the waterproof plug, for airtightly closing an opening (51) of the terminal accommodation chamber, an axial length of said airtight portion (47) being determined in such a way that a rear end portion thereof is flush with or projects outside from an end surface (51*a*) of the opening (51) of the terminal accommodation chamber, irrespective of clamped position of said clamp connection portion (33) relative to the terminal.

Further, said airtight portion (47) is formed with a plurality of annular gill-shaped projections (49) brought into tight surface contact with the inner wall of the terminal accommodation chamber, a rear end portion of the annular gill-shaped projections being determined so as to be flush with or project outside from the opening end surface (51*a*) of the opening (51) of the terminal accommodation chamber, irrespective of clamped position of the clamp connection portion relative to the terminal.

Further, said airtight portion (47) is further formed with annular lip portions (39) between said clamp connection portion (33) and the annular gill-shaped projections so as to be brought into projection contact with the inner wall of the terminal accommodation chamber.

In the above-mentioned rubber waterproof plug, it is preferable that a pitch (L1) of the annular gill-shaped projections (49) is determined smaller than that (L3) of the annular lip portions (39). Further, it is preferable that an axial length (L2) of the annular gill-shaped projections (49) is 1 to 5 mm; a radial height (L4) of the annular gill-shaped projections is 0.2 to 0.4 mm; and the pitch (L1) of the annular gill-shaped projections is 0.2 to 0.4 mm. Further, an outer diameter (2XA) of the annular gill-shaped projections (49) is larger than an inner diameter (2XB) of the inner wall of the terminal accommodation chamber, but smaller than an outer diameter (2XC) of the connector housing. Further, the annular gill-shaped projections (49) are formed so as to extend axially to said clamp connection portion (33).

Further, the present invention provides a method of manufacturing the rubber waterproof plug, wherein the annular gill-shaped projections (49) are formed by use of a molding die formed with an annular gill-shaped projection pattern, or wherein the annular gill-shaped projections (49) are formed into annular cuttings by cutting a cylindrical body radially inward with a cutter at an appropriate pitch.

In the latter case, it is preferable that the cutter is at least one pair of semicircular cutters pushed radially inward of the cylindrical body. Here, either one of the semicircular cutters or the cylindrical body is rotated. Further, it is also preferable that the annular cuttings are spiral cuttings and additionally the cutter is inclined from a surface perpendicular to an axis of the cylindrical body.

In the rubber waterproof plug according to the present invention, even if the waterproof plug is dislocated slightly in the connector housing, since the axial length of the annular gill-shaped projections is determined in such a way that a rear end portion thereof is flush with or projects outside from an end surface of the opening of the terminal accommodation chamber of the connector housing, it is possible to prevent water from staying at the opening surface of the connector housing, thus improving the reliability of the waterproof plug.

Further, since the annular gill-shaped projections of specified dimensions are formed in the waterproof plug so as to be brought into tight surface contact with the inner wall of the terminal accommodation chamber, it is possible to improve the waterproof performance and further to prevent the waterproof plug from being removed from the connector housing.

DETAILED DESCRIPTION OF THE EMBODIMENTS

Embodiments of the rubber waterproof plug according to the present invention will be described hereinbelow with reference to the attached drawings.

Figure 1A:
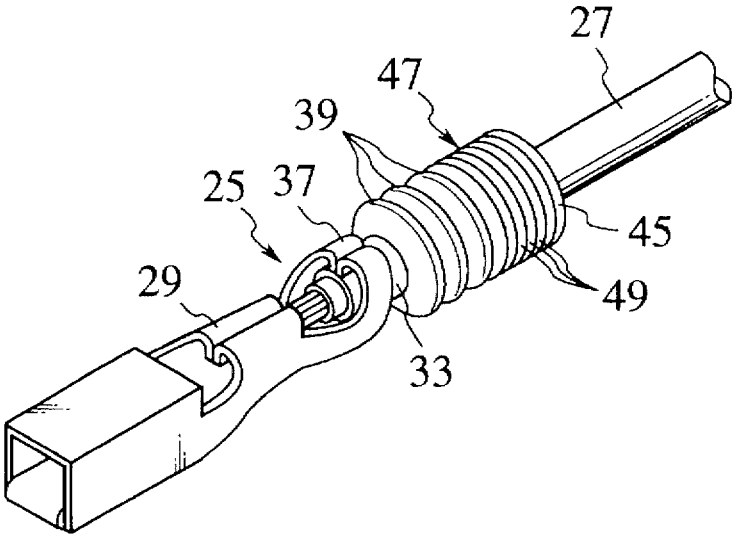
FIG. 1A is a perspective view showing a first embodiment of the rubber waterproof plug according to the present invention.
Figure 1B:
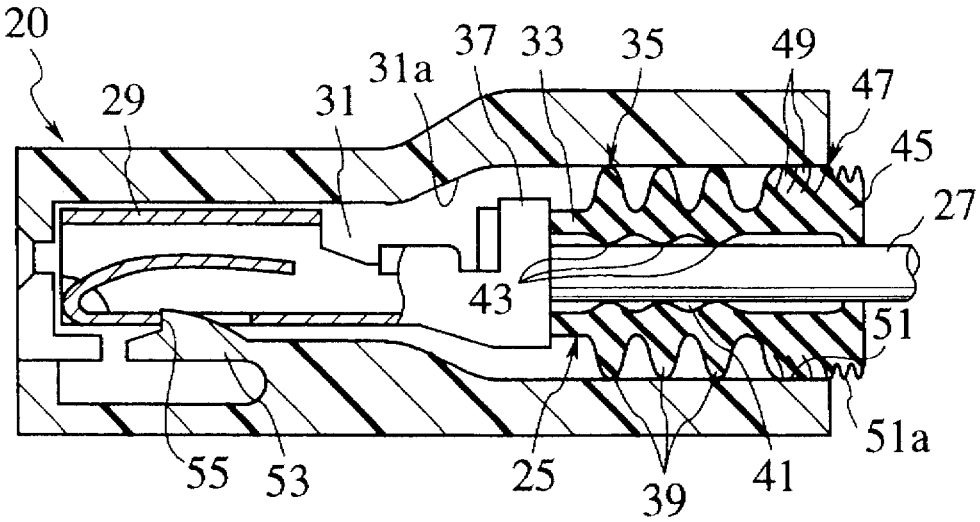
FIG. 1B is a cross-sectional view showing the same rubber waterproof plug clamped to a wire end and then inserted into the terminal accommodation chamber of a connector housing.

In FIGS. 1A and 1B, a rubber waterproof plug 25 is composed of a thin-wall cylindrical clamp connection portion 33 clamped to an end of a wire 27 by use of a terminal 29 and a seal portion 35 brought into tight contact with an inner wall 31*a* of a terminal accommodation chamber 31 of a connector housing 20.

The clamp connection portion 33 is formed into a cylindrical shape so as to be brought into tight contact with the outer circumference of the wire 27. A clamp portion 37 of the terminal 29 is clamped to the outer circumference of the clamp connection portion 33. As a result, the clamp connection portion 33 of the waterproof plug 25 is clamped between the wire 27 and the clamp portion 37 of the terminal 29, and therefore the waterproof plug 25 can be attached to an end of the wire 27.

The seal portion 35 of the waterproof plug 25 is formed with outer annular lip portions 39 brought into tight contact with the inner wall 31*a* of the terminal accommodation chamber 31 of the connector housing at the outer circumference thereof and with inner annular lip portions 43 brought into tight contact with the outer circumference of the wire 27 at the inner circumference thereof. Therefore, when the waterproof plug 25 is inserted into the terminal accommodation chamber 31, the seal portion 35 can be brought into tight contact with both the inner wall 31*a* of the terminal accommodation chamber 31 and the wire 27, so that a gap between the outer circumference of the wire 27 and the inner wall 31*a* of the terminal accommodation chamber 31 can be sealed.

Figure 2:
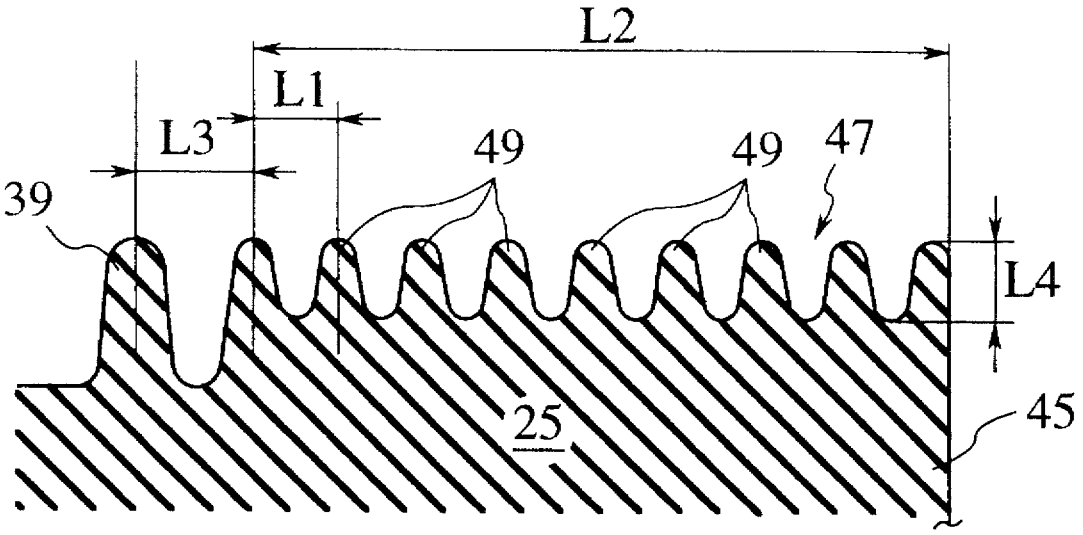
FIG. 2 is an enlarged cross-sectional view showing the annular gill-shaped projections formed in the first embodiment of the rubber waterproof plug according to the present invention.

The feature of the present invention is that the waterproof plug 25 is formed with an annular gill-shaped projection portion (an airtight portion) 47 at a rear end portion 45 of the waterproof plug 25 on the side opposite to the clamp connection portion 33 relative to the seal portion 35. As depicted in FIG. 2, the pitch L1 of a plurality of the annular gill-shaped projections 49 of the annular gill-shaped projection portion 47 is smaller than that L3 of the projections of the outer annular lip portions 39.

These annular gill-shaped projections 49 are formed around the outer circumferential surface of the annular gill-shaped projection portion (airtight portion) 47 at regular intervals beginning from the rear end of the waterproof plug 25. The cross-section shape of each of the annular gill-shaped projections 49 is formed into a circular arc shape at the outer circumferential end portion thereof. The pitch L1 of the annular gill-shaped projections 49 is 0.2 to 0.4 mm, and the preferable pitch L1 is 0.3 mm. Further, the radial height L4 of the annular gill-shaped projections 49 at the rear end portion 45 thereof is 0.2 to 0.4 mm, and the preferable radial height L4 is 0.3 mm.

Figure 3:
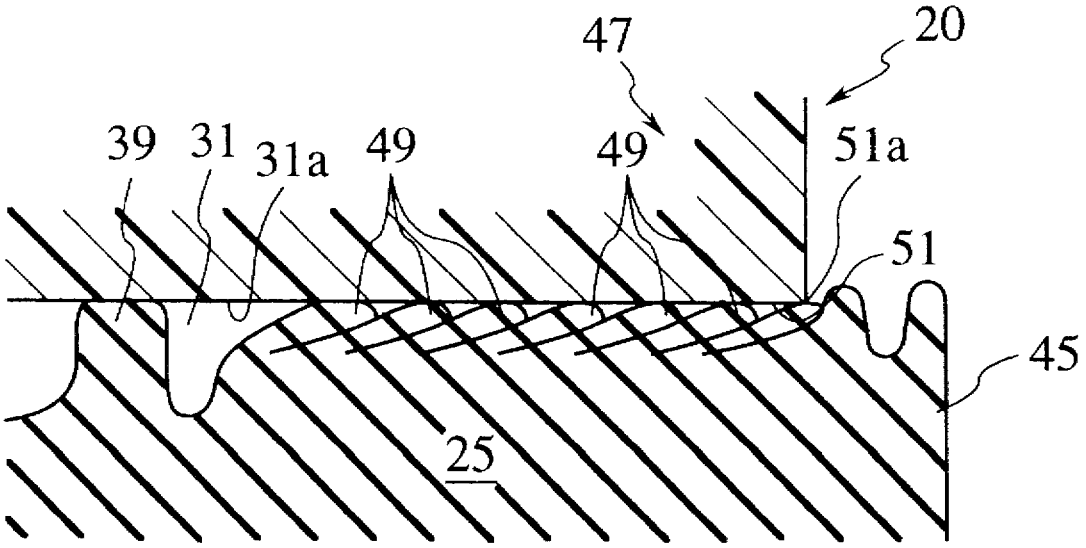
FIG. 3 is an enlarged cross-sectional view showing the brought-down annular gill-shaped projections formed in the first embodiment of the rubber waterproof plug according to the present invention.

As shown in FIG. 3, when the waterproof plug 25 is inserted into the terminal accommodation chamber 31, the annular gill-shaped projections 49 are all deflector down toward the rear opening (51) side of the connector housing 20. In other words, the annular gill-shaped projections 49 fear down one upon another in such a way that a gap between two adjacent annular gill-shaped projections 49 can be eliminated in sequence. In addition, as shown in FIG. 3, the outer end portions of the annular gill-shaped projections 49 are brought into tight contact with the inner wall 31*a* of the terminal accommodation chamber 31, and further deflect in such a way as to form a roughly outer circumferential contact surface relative to the inner wall 31*a* of the terminal accommodation chamber 31.

In other words, since the large areas of the annular gill-shaped projections 49 are brought into tight surface contact with the inner wall 31*a* of the terminal accommodation chamber 37 (being different from that only the large diameter portions of the outer annular lip portions 39 are brought into tight point contact therewith), even if the waterproof plug 25 is shifted or dislocated relative to the connector housing 20, it is possible to keep the waterproof plug 25 always in tight surface contact with the inner wall 31*a* of the terminal accommodation chamber 31.

The length of the annular gill-shaped projection portion 47 composed of the annular gill-shaped projections 49 is determined so as to be flush with the rear end surface 51*a* of the opening 51 (i.e., rear end portion of the connector housing 20) or project outside therefrom, irrespective of the clamped position of the clamp connection portion 33 relative to the terminal 29. That is, the total length of the annular gill-shaped projection portion 47 is 1 to 5 mm or preferably 2 to 4 mm, longer than the axial range of the clamp position at which the clamp connection portion 33 of the waterproof plug 25 is clamped to the end of the wire 27. Therefore, if the clamp portion 37 of the terminal 29 is clamped to the waterproof plug 25 near the seal portion 35 thereof, and the waterproof plug 25 is inserted deeply into the terminal accommodation chamber 31, since the length of the annular gill-shaped projection portion 47 is determined sufficiently long to such an extent that the rear end of the annular gill-shaped projections 49 is flush with the rear opening end surface (i.e., rear end portion of the connector housing 20) or projects therefrom; that is, since the length of the annular gill-shaped projection portion 47 is so determined that the rear end portion 45 of the waterproof plug 25 projects from the connector housing 20 (without being inserted deep into the terminal accommodation chamber 31), it is possible that some of the annular gill-shaped projections 49 will be in tight contact with the rear end surface (opening edge) 51*a* of the rear opening 51 of the terminal accommodation chamber 31, with the result that it is possible to prevent a recessed portion from being produced at the rear end surface (opening edge) 51*a* of the rear opening 51 thereof.

In assembly of the rubber waterproof plug 25 into the terminal accommodation chamber 31 of the connector housing 20, the waterproof plug 25 is attached to a front end of the wire 27 and then clamped to the wire 27 by use of the clamp portion 37 of the terminal 29. The waterproof plug 25 clamped with the wire and the terminal 29 are inserted into the terminal accommodation chamber 31 until an engage hole 55 formed in the terminal 29 is engaged with a flexible engage arm 53 formed in the terminal accommodation chamber 31 of the connector housing 20, so that the terminal 29 can be accommodated in position in the terminal accommodation chamber 31. Under these conditions, the outer annular lip portions 39 of the seal portion 35 of the waterproof plug 25 can be brought into tight contact with the inner wall 31*a* of the terminal accommodation chamber 31 and further the wire 27 can be brought into tight contact with the inner annular lip portions 43 formed in the wire insertion hole 41 of the waterproof plug 25.

Further, in the annular gill-shaped projection portion 47, since a plurality of the annular gill-shaped projections 49 are inclined toward the rear opening (51) side of the terminal accommodation chamber 31 under tight surface contact conditions with the inner wall 31*a* of the terminal accommodation chamber 31, it is possible to securely waterproof the terminal accommodation chamber 31.

Figure 4:
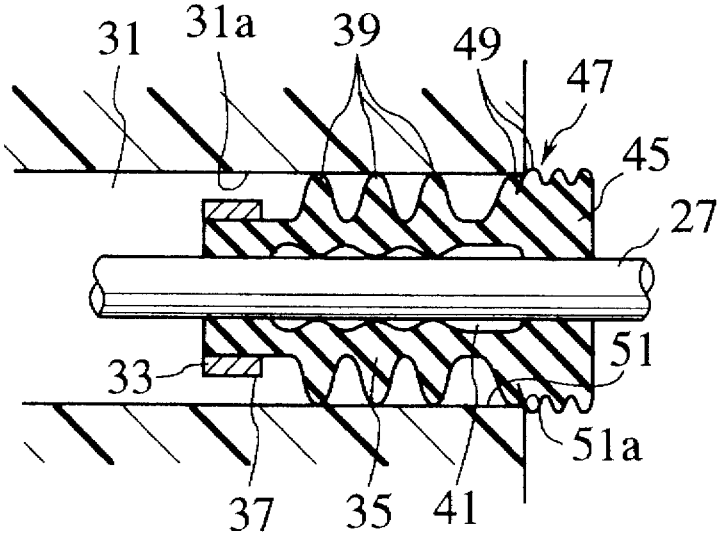
FIG. 4 is a cross-sectional view showing a state where the first embodiment of the rubber waterproof plug according to the present invention is inserted into the terminal accommodation chamber.

In assembly, where the waterproof plug 25 is clamped with the wire 27 by the clamp portion 37 of the terminal 29 near the front end side of the clamp connection portion 33 of the waterproof plug 25 as shown in FIG. 4, since the waterproof plug 25 is located outside relative to the terminal accommodation chamber 31, the rear end portion of the annular gill-shaped projection portion 47 projects from the rear end opening 51 of the terminal accommodation chamber 31. Under these conditions, however, since some annular gill-shaped projections 49 bear one upon another in such a way that the two adjacent annular gill-shaped projections 49 are brought into tight contact with each other and thereby into tight surface contact with the inner wall 31*a* of the terminal accommodation chamber 31, it is possible to prevent a recessed portion from being produced at the rear end surface 51*a* of the opening 51 of the connector housing 20, so that water is prevented from staying thereat.

Figure 5:
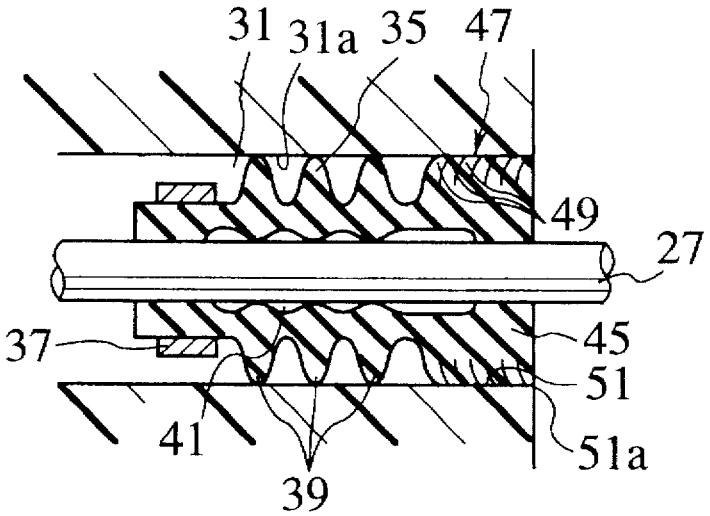
FIG. 5 is a cross-sectional view showing another state where the embodiment of the rubber waterproof plug according to the present invention is inserted into the terminal accommodation chamber.

On the other hand, where the waterproof plug 25 is clamped with the wire 27 by the clamp portion 37 of the terminal 29 near the seal portion 35 of the waterproof plug 25 as shown in FIG. 5, since the waterproof plug 25 is located deep inside relative to the terminal accommodation chamber 31, the rear end portion of the annular gill-shaped projection portion 47 is located deep inside of the terminal accommodation chamber 31. Under these conditions, however, since the rear end of the annular gill-shaped projection portion 47 is located flush with the rear end surface 51*a* of the opening 51 of the terminal accommodation chamber 31, the respective annular gill-shaped projections 49 bear one upon another in such a way that the two adjacent annular gill-shaped projections 49 are brought into tight contact with each other and thereby into tight surface contact with the inner wall 31*a* of the terminal accommodation chamber 31. As a result, it is possible to prevent a recessed portion from being produced at the rear end surface 51*a* of the opening 51 of the connector housing 20, so that water is prevented from staying thereat.

in other words, even if the position at which the waterproof plug 25 is clamped to the wire 27 by the clamp portion 37 of the terminal 29 is not uniform and therefore shifted, since the two adjacent annular gill-shaped projections 49 are always brought into tight contact with each other and thereby into tight surface contact with the inner wall 31*a* of the terminal accommodation chamber 31 and further since the rear end portion of the annular gill-shaped projection portion 47 is not located deep inside the opening 51 of the terminal accommodation chamber 31, it is possible to prevent a recessed portion from being produced at the rear end surface 51*a* of the opening 51 of the connector housing 20, so that it is possible to prevent water from staying at the opening of the connector housing 20. Accordingly, since water will not stay at the opening end of the connector housing 20, even if the connector housing 20 is heated or vibrated, it is possible to securely waterproof the gap between the wire 27 and the inner wall 31*a* of the terminal accommodation chamber 31 of the connector housing 20.

Figure 6A:
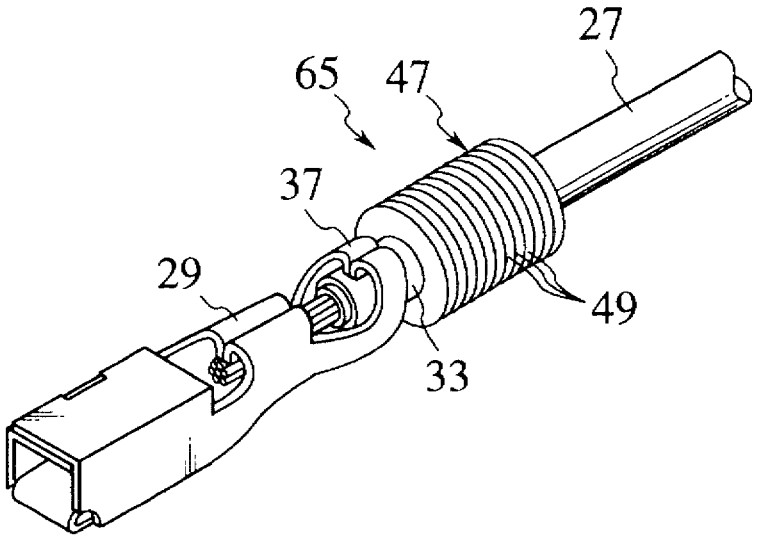
FIG. 6A is a perspective view showing a second embodiment of the rubber waterproof plug according to the present invention.
Figure 6B:
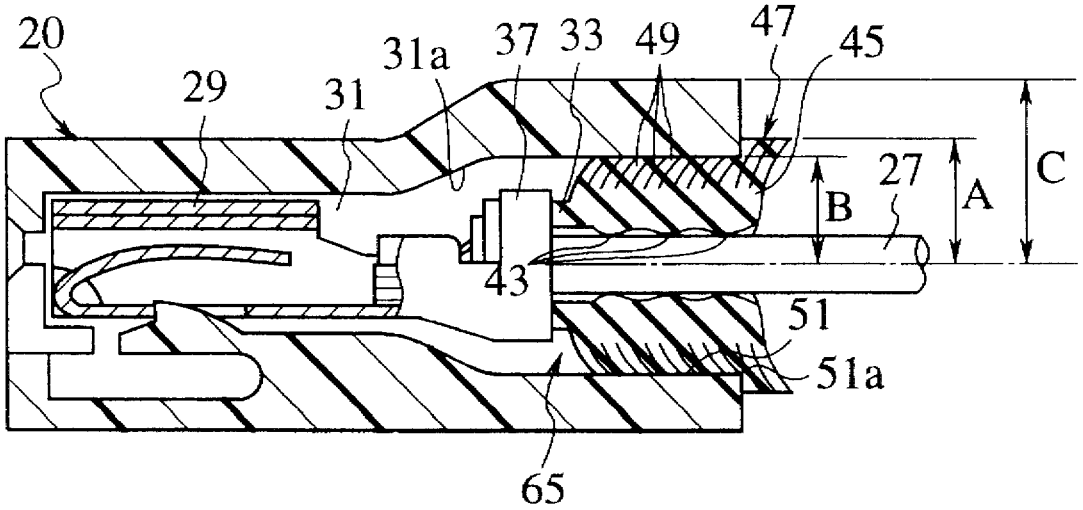
FIG. 6B is a cross-sectional view showing the same rubber waterproof plug clamped to a wire end and then inserted into the terminal accommodation chamber of a connector housing.

A second embodiment of the waterproof plug according to the present invention will be described with reference to FIGS. 6A and 6B. In the waterproof plug 65 of the second embodiment, the outer annular lip portions 39 are omitted, and instead the annular gill-shaped projection portion 47 extends to the clamp connection portion 33. In this second embodiment, the diameter relationship among an outer diameter 2XA of the annular gill-shaped projections 49, an inner diameter 2XB of the terminal accommodation chamber 31, and an outer diameter 2XC of the connector housing 20 (i.e., a dimension from the central axis of the opening 51 of the terminal accommodation chamber 31 and the outer surface of the connector housing 20) can be expressed as $B<A\leqq C$. In the waterproof plug 65 of this second embodiment, the axial length thereof is determined in such a way that the rear end portion of the annular gill-shaped projection portion 47 is flush with or projects from the rear end surface 51*a* of the opening 51 of the terminal accommodation chamber 31.

In this second embodiment, when the waterproof plug 65 is inserted into the connector housing 20, since the annular gill-shaped projections 49 of the annular gill-shaped projection portion 47 are brought into tight surface contact with the inner wall 31*a* of the terminal accommodation chamber 31, the annular gill-shaped projections 49 can serve as the outer annular lip portions 39. Further in this second embodiment, since the outer annular lip portions 39 can be omitted and only the annular gill-shaped projections 49 are formed, it is possible to simplify the structure of the waterproof plug 65. Further, since the number of the annular gill-shaped projections 49 is large, after the annular gill-shaped projections 49 have been inserted into the terminal accommodation chamber 31, there exists such an advantage that the waterproof plug 65 cannot be removed easily even if a force is applied in the direction that the waterproof plug 65 is removed, because of the wedge effect of the annular gill-shaped projections 49.

The method of manufacturing the annular gill-shaped projection portion 47 of the waterproof plug will be described hereinbelow.

A first method is to form the annular gill-shaped projections 49 together with the waterproof plug. That is, a pattern of the annular gill-shaped projections 49 is formed on an inner surface of a molding die of the waterproof plug. In this case, the waterproof plug formed with the annular gill-shaped projection portion 47 can be molded simultaneously by flowing melt rubber into the molding die. Although this molding method is simple, it is impossible to form the fine or minute annular gill-shaped projections 49 on the outer circumferential surface of the waterproof plug, so that it is rather difficult to obtain the soft annular gill-shaped projections 49.

A second method is to first mold a cylindrical rubber body, and then to cut off the annular gill-shaped projections 49 on the outer surface of the cylindrical rubber body with the use of a cutter. In this method, all the portions other than the annular gill-shaped projections 49 are molded, and only the annular gill-shaped projections 49 are cut off with a cutter. In this method, since the cutting depth and the cutting pitch can be easily controlled, it is possible to obtain the fine annular gill-shaped projections 49 and thereby to provide a softness to the annular gill-shaped projections 49.

Figure 7A:
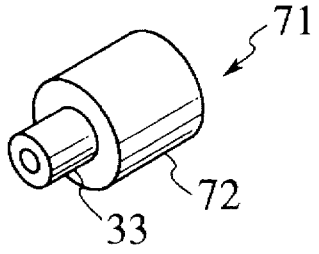
FIGS. 7A to 7C are perspective views for assistance in explaining a first example of the method of manufacturing the rubber water plug according to the present invention.
Figure 7B:
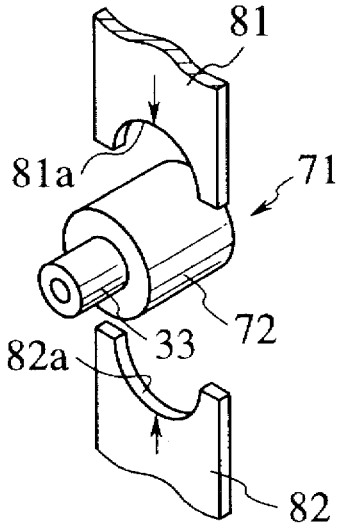
Figure 7C:
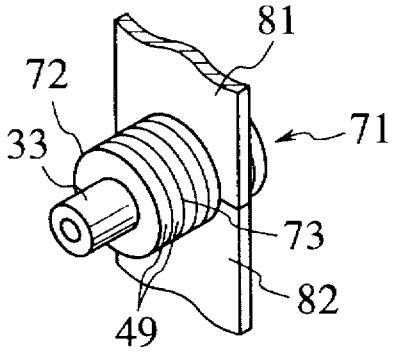
Figure 7A:
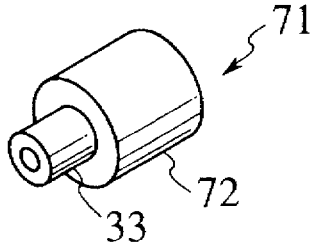
Figure 7B:
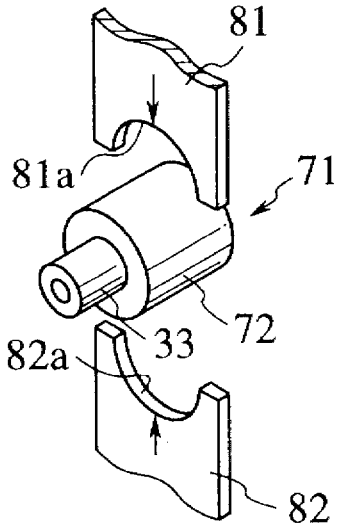
Figure 7C:
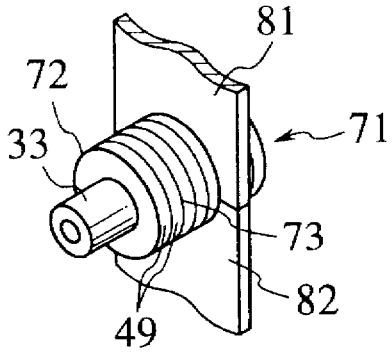

A first example of this method will be explained in further detail with reference to FIGS. 7A to 7C. As shown in FIG. 7A, a cylindrical body 71 formed with the clamp connection portion 33 and the thick-wall cylindrical portion 72 is molded with the use of a molding die. After that, as shown in FIG. 7B, a pair of semicircular cutters 81 and 82 formed with semicircular cutting edges 81*a* and 82*a*, respectively are prepared, and then pushed toward the molded cylindrical body 71 in such a way as to be sandwiched between these semicircular cutters 81 and 82 in the arrow direction in FIG. 7B. In this case, the cutting depth of each of the semicircular cutters 81 and 82 is about a half of the wall thickness of the cylindrical body 71. Further, as shown in FIG. 7C, annular cuttings with a predetermined depth in the wall thickness direction are formed on the outer circumferential surface of the thick-wall cylindrical portion 72 at regular intervals (with a constant pitch) along the axial direction of the thick-wall cylindrical portion 72, in order to form a plurality of annular gill-shaped projections 49. Further, when the thick-wall cylindrical portion 72 is cut in with the cutters 81 and 82 to form cuttings 73, it is preferable to rotate the cylindrical portion 71 when the two opposing cutters 81 and 82 are being brought closer to each other gradually. In this method, it is possible to obtain more smooth and fine cuttings 73 on the circumferential surface of the cylindrical portion 72.

Further, without being limited to only the semicircular cutters 81 and 82, it is also possible to use a straight cutter for cutting the rotating cylindrical body 72.

Figure 8A:
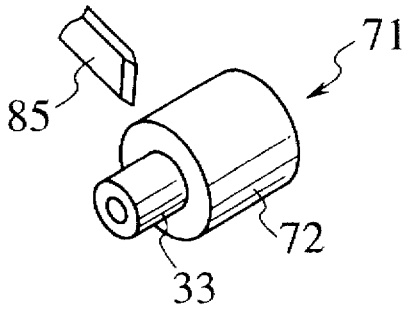
FIGS. 8A to 8C are perspective views for assistance in explaining a second example of the method of manufacturing the rubber waterproof plug according to the present invention.
Figure 8B:
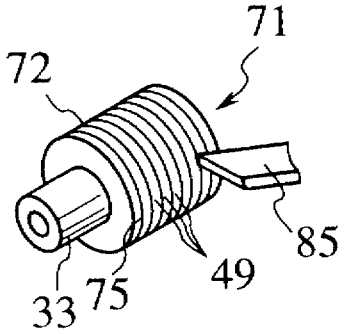
Figure 8C:
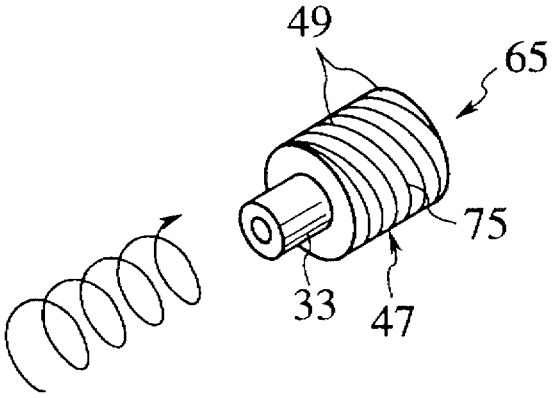

A second example of this method will be explained in further detail with reference to FIGS. 8A to 8C. As shown in FIG. 8A, a cutter 85 formed with a straight cutting edge is prepared, and set on the outer circumferential surface of the thick-wall cylindrical portion 72 of the cylindrical body 71 in such a way as to be cut into the cylindrical body 71. Under these conditions, as shown in FIG. 8B, the cutter 85 or the cylindrical body 71 is rotated to form an annular cutting 75 with a predetermined depth. Further, when the cutter 85 is shifted at a constant pitch in sequence, it is possible to obtain a number of the annular gill-shaped projections 49. In this case, as shown in FIG. 8C, when the cylindrical body 71 is rotated by shifting the cutter 85 gradually in the axial direction of the cylindrical body 71, it is possible to form a spiral cutting 75 on the outer circumferential surface of the thick-wall cylindrical portion 72. That is, in this case, it is possible to obtain the annular gill-shaped projection portion 47 of a spiral gill-shaped projection 49.

Further, without being limited only to the above-mentioned methods, it is possible to cut the cylindrical body 72 by use of various cutters other than mechanical cutters.

Further, in the above-mentioned embodiments, the annular gill-shaped projection portion 47 is used to waterproof the terminal accommodation chamber 31. However, it is possible to replace the annular gill-shaped projection portion 47 with a soft cylindrical portion of simple shape, as far as the cylindrical portion can be brought into tight surface contact with the inner wall 31*a* of the terminal accommodation chamber 31. In this case, the axial length of the airtight cylindrical portion is also determined in such a way that the rear end portion of the airtight cylindrical portion is flush with or projects from the rear end surface 51*a* of the opening 51 of the terminal accommodation chamber 31.

Further, when the annular gill-shaped projections 49 are formed by cutting the cylindrical body 71, it is possible to cut the cylindrical body 71 by inclining the cutter 81, 82 or 85 at a predetermined inclination angle relative to a surface perpendicular to the axial direction of the cylindrical body 71. In this case, since the inclined annular gill-shaped projections can be formed, there exists such an advantage that the waterproof plug can be inserted into the terminal accommodation chamber 31 more smoothly, because the insertion resistance of the annular gill-shaped projections into the connector housing 20 can be reduced.

As described above, in the waterproof plug according to the present invention, even if the waterproof plug is dislocated slightly in the connector housing, since the axial length of the annular gill-shaped projections is determined in such a way that a rear end portion thereof is flush with or projects outside from an end surface of the opening of the terminal accommodation chamber of the connector housing, it is possible to prevent water from staying at the opening surface of the connector housing, thus improving the reliability of the waterproof plug.

Further, since the annular gill-shaped projections of specified dimensions are formed in the waterproof plug so as to be brought into tight surface contact with the inner wall of the terminal accommodation chamber, it is possible to improve the waterproof performance and further to prevent the waterproof plug from being removed from the connector housing.

What is claimed is:

1. A combination of a connector housing having a rear end surface and an opening through the rear end surface, the opening having an inner wall forming a terminal accommodation chamber, a terminal having a wire attached thereto and inserted into the opening from the rear end surface of the housing, said wire having an outer circumference, and a rubber waterproof plug fitted to the outer circumference of the wire and inserted into the terminal accommodation chamber together with the terminal from a rear end of the connector housing to seal a gap between the wire and an inner wall of the terminal accommodation chamber, said rubber waterproof plug comprising:

a clamp connection portion formed at a front end portion of the rubber waterproof plug and clamped with a front end of the wire by the terminal;

a plurality of annular gill-shaped projections formed at a rear end portion of the rubber waterproof plug to have a diameter and a pitch between adjacent annular gill-shaped projections such that at least some of said annular gill-shaped projections are deformed axially to sealingly bear against one another when said rubber waterproof plug is inserted into said opening, an axial length of said annular gill-shaped projections being determined so as to be flush with or project outside the rear end surface of the connector housing irrespective of the clamped position of the clamp connection portion of the rubber waterproof plug relative to the terminal; and a plurality of inner and outer annular lip portions formed between said clamp connection portion and said annular gill-shaped projections so as to be brought into contact with the outer circumference of the wire and the inner wall of the terminal accommodation chamber, respectively, said annular lip portions having a pitch greater than the pitch of said annular gill-shaped projections and being compressed primarily radially rather than axially.

2. The combination of claim 1, wherein an axial length of said annular gill-shaped projections is 1 to 5 mm; a radial height of said annular gill-shaped projections is 0.2 to 0.4 mm; and the pitch of said annular gill-shaped projections is 0.2 to 0.4 mm.

3. The combination of claim 1, wherein an outer diameter of said annular gill-shaped projections is larger than an inner diameter of the inner wall of said terminal accommodation chamber and smaller than an outer diameter of said connector housing.

4. The combination of claim 1, wherein said annular gill-shaped projections are formed so as to extend axially with respect to said clamp connection portion.

5. The combination of claim 1, wherein said annular gill-shaped projections are formed at an inclination relative to a surface perpendicular to the axis of said rubber waterproof plug.

* * * * *